United States Patent [19]

Weigl

[11] 3,993,932

[45] Nov. 23, 1976

[54] ANTISTATIC FOOTWEAR

[76] Inventor: John W. Weigl, 534 Wahlmont Road, West Webster, N.Y. 14580

[22] Filed: Jan. 16, 1976

[21] Appl. No.: 649,590

[52] U.S. Cl. ..... 317/2 B

[51] Int. Cl.[2] ..... A61N 1/14; H05F 3/00

[58] Field of Search ..... 317/2 R, 2 B; 174/5 SB, 174/5 SG

[56] References Cited

UNITED STATES PATENTS

| | | | |
|---|---|---|---|
| 3,532,932 | 10/1970 | Simon | 317/2 R |
| 3,723,811 | 3/1973 | Koeleveld et al. | 317/2 R |
| 3,798,503 | 3/1974 | Larsh et al. | 317/2 B |

FOREIGN PATENTS OR APPLICATIONS

| | | | |
|---|---|---|---|
| 1,024,187 | 3/1966 | United Kingdom | 317/2 B |

*Primary Examiner*—Harry Moose
*Attorney, Agent, or Firm*—Stonebraker, Shepard & Stephens

[57] ABSTRACT

Antistatic footwear uses a conductive layer above a bottom dielectric layer and extending to the peripheral edge of of the bottom layer to form a discharge edge emitting at least a portion of the static electricity built up with movement of the wearer. The discharge automatically keeps the electrostatic charge to a relatively low level, either eliminating or reducing the intensity of any spark occurring when the wearer touches a grounded object, and yet the wearer is preferably insulated from ground to prevent hazardous electrical grounding of the wearer. The static electric potential on the wearer can be lowered further by forming a conductive path from the conductive layer to the underside of the bottom layer.

23 Claims, 9 Drawing Figures

ANTISTATIC FOOTWEAR

BACKGROUND OF THE INVENTION

Static electric charges exceeding sparking potential and easily reaching 10kv and more are often created by engagement between different materials as a person moves about, especially in the relatively low-humidity environment inside buildings in the wintertime. The movement of footwear across a rug or movement between clothing and upholstery can easily build up an electrostatic charge that produces an electric spark when the person touches a grounded object. The sparks can exceed 1mm in length and can be painful and annoying, even though they draw little current.

Prior art solutions have included electrically conductive shoe bottoms, particularly compositions containing high percentages of conductive carbon particles. These are unsatisfactory for general use, because they abrade easily, leaving black marks, and they are safety hazards by offering a low resistance path to ground through the body of the wearer, who may be exposed to 110v or 220v from a defective household appliance. Also, conductive shoe bottoms must be worn on a conductive surface to be effective, and they are usually limited to potentially explosive environments.

Another prior art solution is antistatic materials applied to the surfaces of carpet fibers. Unfortunately, the materials used are generally ionic and depend upon ambient moisture to provide surface conductivity so they are generally unsatisfactory when relative humidity drops below 20%–25%, as frequently occurs indoors in winter. Also, these materials can only discharge the carpet fibers, and cannot discharge a person walking over the carpet.

Another potential solution is to make shoe bottoms of materials triboelectrically close enough to the floor covering to avoid electrostatic buildup. However, the wide varieties of floor coverings makes this unworkable. Finally, the surest way to avoid the shock from a spark is to moisten the hand and touch a wall, or use a coin or key to touch a grounded object, but this requires considerable forethought.

The prior art is well explained in an article entitled "Static Electricity in Textiles", by K. W. Mieszkis, and a copy is enclosed with this application. The article not only describes prior art attempts to solve the problem, but points out that the static electric potentials built up on the wearer are prodigious and readily reach thousands of volts. The hazards and annoyances of static electric charges are also evaluated in other technical literature.

The invention aims at a solution to the problem in the form of footwear that automatically prevents buildup of an electrostatic charge on the wearer, and the invention also seeks economy and simplicity in making footwear that prevents the build-up of an electrostatic charge.

SUMMARY OF THE INVENTION

The invention involves recognition that a discharge edge can be arranged to discharge all the static electricity exceeding a threshold potential to prevent the charge from reaching sparking potential, and the invention also recognizes ways that a corona or contact discharge can be produced in a simple, inexpensive, and effective way in footwear for automatically protecting the wearer from spark shocks.

More specifically, the invention applies to footwear incorporating dielectric material forming a bottom or interior layer so that the footwear is not electrically conductive from the wearer to ground. An electrically conductive layer is arranged above the bottom layer, and the conductive material extends to the outer periphery of the bottom layer, where it provides a discharge edge exposed to ambient atmosphere at the outer periphery of the bottom layer. The conductive material preferably includes electrically conductive strands in a woven cloth or screen arranged so the ends of the strands are exposed at the periphery of the footwear to form the discharge edge. The wearer is then insulated from ground, but is protected from buildup of an electrostatic charge because the discharge occurs automatically at the exposed edge of the conductive material. The discharge occurs not only by corona emission, but by field emission or contact with nearby carpet fibers, and preferably an electrically conductive path extends from the conductive layer to the underside of the shoe bottom for making electrical contact between the conductive layer and the dielectric carpet fibers under the shoe bottom for further discharge of the static electric charge. The inventive construction is simple, inexpensive, and easily incorporated into present footwear manufacturing processes.

DRAWINGS

DETAILED DESCRIPTION

Figure 1:
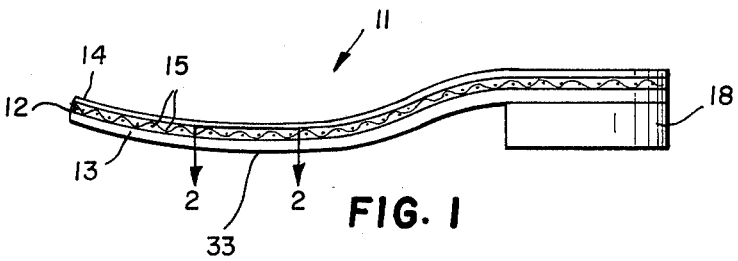
FIG. 1 is a partially schematic, side elevational view of a shoe bottom according to the invention.
Figure 2:
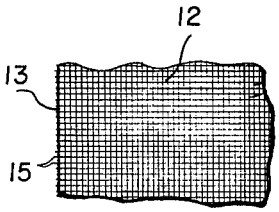
FIG. 2 is a fragmentary cross-sectional view of the shoe bottom of FIG. 1 taken along the line 2—2 thereof.

"Shoe bottom" is used throughout this application to refer to shoe soles, shoe heels, or both, as an encompassing term for the bottom of a shoe, however it may be formed or styled. Shoe bottom 11 of FIG. 1 includes a heel 18, but can also be heelless and flat, or even have a negative heel. It includes a bottom layer 13, an electrically conductive material 12 forming an electric shield above bottom layer 13, and preferably an upper layer 14 above conductive layer 12. Conductive layer 12 extends to the outer periphery of bottom layer 13, as best shown in FIG. 2, and is preferably formed as a screen or cloth woven at least partially of conductive strands having a multitude of ends 15 exposed along the outer periphery of bottom layer 13. Various possibilities are described in more detail below, but the ends 15 of the conductive strands of layer 12 are exposed to ambient atmosphere above bottom layer 13 and provide a corona discharge automatically protecting the wearer from spark shocks. The electrostatic charge created when the wearer walks across the rug is discharged by a combination of corona emission, field emission, and contact discharge between the strand ends 15 and dielectric carpet fibers before the charge can migrate upward to the body of the wearer sufficiently to cause a shock when the wearer touches a grounded object.

The discharge edge formed of conductive strand ends 15 is preferably relatively thin or sharp, and strand ends 15 preferably have an effective radius of curvature of less than 125 microns to facilitate corona emission, which can typically be made to occur at about 2.3kv for negative charges and 3.5kv to 4kv for positive charges. This is explained by R. G. Vyverberg in an article entitled "Charging Photoconductive Surfaces" in Chapter 7, pages 203-4 of J. H. Dessauer & Clark *Xerography and Related Processes*, Focal Press, London & New York, 1965. Generally, reducing the thickness or effective radius of curvature of the discharge edge reduces the potential at which emission occurs and lowers the maximum charge that can build up in the shoes and their wearer. The potential reduction for corona emission tends to taper off with edge thicknesses of less than 125 microns, although there is no lower limit on the thickness of the discharge edge other than practical limits for the materials involved. The discharge edge can easily be made thin enough to limit the maximum electrostatic charge to a potential substantially below the potential required for spark emission for automatically keeping the footwear and the wearer at an electrostatic potential reliably below the sparking threshold so that no spark will occur when the wearer touches a grounded object.

If a woven fabric or screen material is used for conductive layer 12, the conductive strands are preferably spaced closely enough to drain the charge effectively from the entire friction contact area for fully protecting the wearer from upwardly migrating charges. For example, the conductive strands in an electrically shielding grid are preferably spaced from ⅛ inch to 1/200 inch. The corona shield 12 then provides a well-defined equipotential plane capturing the frictionally generated charge as it passes from shoe bottom 13 upward toward the wearer, and permits the charge to be repelled to pointed ends 15 where the charge above the corona emission threshold is quickly emitted into the air in the form of corona ions deposited on the surrounding carpeting. Since the corona threshold for sharp points or edges is generally substantially below the threshold for spark emission, the body of the wearer never reaches a potential at which it can draw uncomfortable sparks to ground. In effect, corona emission from the edges of conductive shield 12 enables the shield to act as a safety "fuse" that keeps the wearer at a potential reliably below sparking threshold. Reasons for this are explained in the following publications: W. Lama & C. Gallo, *Journal of Applied Physics*, Vol. 45, No. 1, January, 1974, p. 103 ff; and "The Sparking Characteristics of Needle-to-Plane Coronas", Proc. IEEE, Industrial Applications Meeting No. 8, Milwaukee, Wisconsin, October 8–11, 1973; R. M. Schaffert, "Electrophotography", Focal Press, London & New York, 1965; E. Nasser, "Fundamentals of Gaseous Ionization and Plasma Electronics", (Wiley/Interscience, New York, 1971); L. B. Loeb, "Electrical Coronas", University of California Press, Berkeley 1965; Meek & Craggs, "Electrical Breakdown of Gases", Oxford, 1953. Additional discharge to potentials below corona thresholds can be secured by conductive contact between conductive layer 12 and carpeting fibers or ground as explained more fully below.

Bottom layer 13 preferably has a resistivity of at least $10^6$ ohm-centimeters and preferably more than $10^{10}$ ohm-centimeters; this is easily accomplished with conventional leather, rubber, crepe, cork, and synthetic rubber or plastic compositions currently used in footwear. Upper layer 14 is also preferably insulating to give strand ends 15 well-defined discharge points to the ambient atmosphere to assure effective corona discharge when this is to be the main discharge mechanism. Under these conditions, upper layer 14 can be a "leaky" dielectric and preferably has a resistivity of at least $10^4$ ohm-centimeters. However, in those alternative structures where the conductive strands are electrically connected to the underside 33 of the shoe bottom 13, upper layer 14 should have sufficient resistivity to limit any current, which might be drawn from accidental contact of the wearer with a 110–220V current source, below levels which are hazardous. According to a typical safety standard, ANSI standard Z-41.5 (1944) published by the American National Standards Institute, such currents must be less than 10ma and preferably less than 4ma. Accordingly, the resistivity of inner sole 14 should, in such structures, exceed $5 \times 10^6$ ohm-centimeters, and preferably $10^8$ ohm-centimeters, to be on the safe side.

Conductive layer 12 can be formed of a fine metal screen or cloth woven of conductive strands, such as carbonized acrylic threads, or stainless steel yarn. Many materials can be used in strands woven in with the conductive strands, the edges of which should preferably have a radius of curvature less than 125 microns so that strand ends 15 form effective corona discharge points. Layer 12 need not have a discharge edge around the entire periphery of bottom layer 13, and although a single point might suffice in principle, a multitude of strand ends 15 are preferably exposed to ambient atmosphere somewhere along the outer periphery of bottom layer 13. Conductive layer 12 also need not extend over the entire surface of bottom layer 13, although this is preferred. Conductive layer 12 can be laminated to a shoe bottom material or glued or stitched or secured in place in any convenient way.

Figure 8:
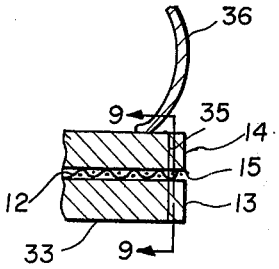
FIG. 8 is a fragmentary, cross-sectional view of the edge region of a shoe bottom made according to another preferred embodiment of the invention.
Figure 9:
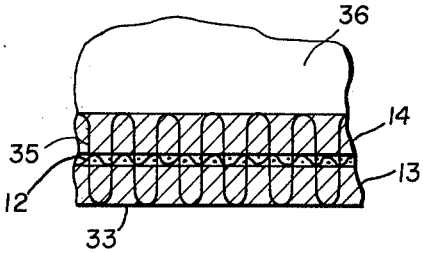
FIG. 9 is a fragmentary, cross-sectional view of the shoe bottom of FIG. 8, taken along the line 9—9 thereof.

In addition to corona emission from strand ends 15 to the atmosphere and to nearby dielectric carpet fibers or ground, further discharge can be accomplished by providing a conductive path from conductive layer 12 to the underside 33 of bottom layer 13. One convenient way of doing this is shown in FIGS. 8 and 9, where stitching 35 with a conductive thread extends through conductive layer 12 to the underside 33 of bottom layer 13 to form an electrically conductive path from conductive layer 12 to carpet fibers or ground at the underside 33 of bottom layer 13. Nails can be substituted for conductive stitching strands 35 to achieve the same effect, or conductive strands can extend from conductive layer 12 over the peripheral edge of bottom layer 13 to the underside 33. Conductive stitching 35 can also extend only from conductive layer 12 through bottom layer 13 to the underside 33 without extending through upper layer 14, and if strands 35 extend through upper layer 14 as shown in FIGS. 8 and 9, stitching 35 is preferably arranged outside the shoe upper 36 as illustrated to be insulated from the wearer's foot and prevent any grounding of the wearer.

The combination of discharge from strand ends 15 and from strands 35 or other conductive path to the underside 33 of shoe bottom 13 produces several possibilities for keeping the static electric potential low. Discharge of static electricity from the sharply edged or pointed conductors 15 can involve more than one mechanism, depending on the potential difference and spacing between conductor ends 15 and a charge-receiving surface.

As described by Schaffert ("Charge Transport Mechanisms in the Transfer of Latent Electrostatic Images to Dielectric Surfaces", R. M. Schaffert, IBM Journal of Research & Development, Vol. 6, No. 2, April 1962, copy attached) corona emission tends to dominate at spacings in excess of (typically) $10^6$ micrometers and voltages above about 400V (the minimum of the "modified Paschen curve" —see his FIG. 3, p. 194). As the discharge edge approaches more closely to the uncharged surface, field emission becomes effective and allows further discharge below about 400V. If the discharge edge is pressed into firm contact with the charge-receiving surface, the corona threshold may be avoided, and virtually complete discharge achieved, even when the contacting surface is a dielectric. This advantage can be achieved as explained above by bringing the conductive layer 12 into electrical contact with the carpet or floor by having the conductive strands of layer 12 extend to the underside 33 of shoe bottom 13 or by using conductive stitching 35 or other conductive element providing a conductive path from screen 12 to the underside 33 of shoe bottom 13.

Figure 3:
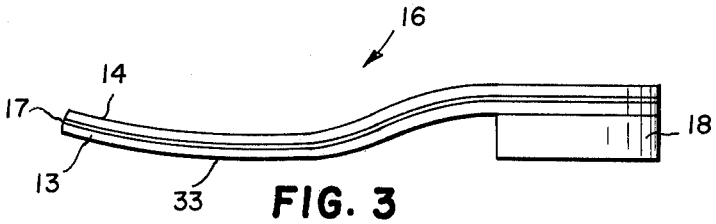
FIG. 3 is a partially schematic, side-elevational view of another preferred embodiment of the invention applied to a shoe bottom.

The alternative of a conductive metallic layer 17 between bottom layer 13 and upper layer 14 is illustrated in FIG. 3. Layer 17 can be formed of thin metallic foil or of a metallic layer vacuum-deposited directly onto layer 13 or onto a thin material such as a resin sheet secured to layer 13. Layer 17 is also preferably less than 250 microns thick and extends to the outer periphery of bottom layer 13 to provide a continuous discharge edge. Corona emission from the edge of conductive layer 17 is also substantially below sparking potential to operate in the same general way as previously described for conductive strand ends 15. Also, conductive stitching, nails, or other conductive element can be used to provide an electrical path from layer 17 to the underside 33 of shoe bottom 13 for additional discharge as described above.

Figure 4:
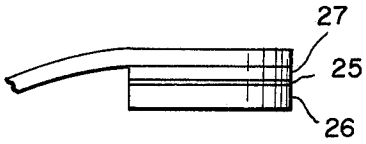
FIG. 4 is a partially schematic, fragmentary, side-elevational view of another preferred embodiment of the invention applied to the heel of a shoe.

A conductive layer of foil or screen 25 can also be arranged in a shoe heel as best shown in FIG. 4. The heel illustrated in FIG. 4 is made up of a bottom layer 26 and a top layer 27 laminated to opposite sides of conductive shield 25. Such a laminate can be factory made and sold to shoe repair shops for heel replacements for shoes. Nails, glue, or stitching can be used for attaching the heel to the shoe in the usual way, and a conductive path can be provided from shield 25 to the bottom of the heel for contact discharge as explained above.

Figure 5:
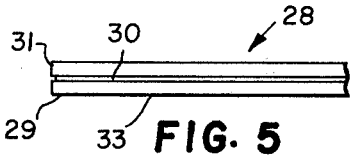
FIG. 5 is a partially schematic, side-elevational view of a laminated material usable for making shoe bottoms according to the invention.

Another shoe bottom laminate 28 is shown in FIG. 5 as having a bottom layer 29, a conductive shield formed of a screen or metallic layer 30, and an upper layer 31. Laminate 28 can be preformed to provide a material for construction of shoe bottoms or a material for use in repair or replacing shoe bottoms. For example, the laminate of FIG. 5 can be combined with the heel of FIG. 4 in a shoe repair to give an antistatic effect to an existing pair of shoes. Of course, preformed laminates according to the invention can also be used for making new shoes, and the laminate can be preformed with conductive stitching or other conductive elements providing an electrically conductive path from layer 30 to the underside 33 of bottom layer 29 for contact discharge in addition to other discharges.

Figure 6:
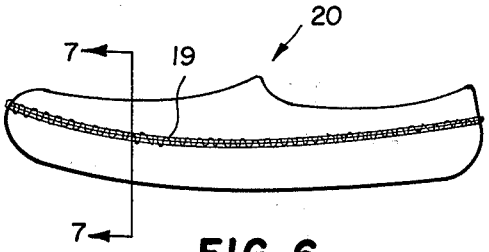
FIG. 6 is a partially schematic, side elevational view of another preferred embodiment of the invention applied to a soft shoe.
Figure 7:
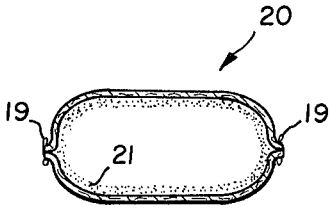
FIG. 7 is a cross section of the shoe of FIG. 6 taken along the line 7—7 thereof.

Another alternative shown in FIGS. 6 and 7, as applied to a soft shoe 20, such as a slipper or moccasin, is peripheral stitching with a fine conductive wire, such as a stainless steel thread less than 250 microns in diameter. The stitching pattern for wire 19 then forms a discharge edge at or above the bottom of soft footwear 20, and wire 19 is preferably insulated from the foot of the wearer by a dielectric material, such as pile lining 21 shown in FIG. 7. This prevents shock hazards from a conductive path from the foot of the wearer through the wire 19 to ground.

Some carpets have deep enough pile so that footwear according to the invention can sink into the pile and allow some engagement between the corona discharge edge and the pile fibers. As explained above, this also helps dissipate an electrostatic charge and reduces the electrostatic potential still further without establishing a conductive path from the wearer to ground.

The effectiveness of the invention in producing emissions to keep a static electric charge below a sparking threshold has been demonstrated experimentally. Various materials were used, and charges on a test disk were measured to determine the corona discharge effect of various shield conductors placed in electrical contact with the disk. The results generally showed that a conductive layer of screen, conductive cloth, or a metallic foil quickly discharges enough of a static electric charge to keep the potential below the sparking threshold and that light contact of the discharge edge with carpeting pile further reduces the potential.

Those skilled in the art can apply the invention to footwear in many ways, once they have the basic concepts explained above. Many different conductive materials and dielectric materials having different dimensions and parameters can be used, and the conductive material providing a discharge edge can be built into a shoe bottom along with the dielectric materials in ways readily apparent to those skilled in the shoe-manufacturing art.

What is claimed is:

1. Antistatic footwear comprising:

a. dielectric material forming a bottom layer of said footwear;

b. an electrically conductive material above said bottom layer;

c. said conductive material extending to the outer periphery of said bottom layer; and d. said conductive material having a discharge edge exposed to ambient atmosphere in the region of said outer periphery of said bottom layer.

2. The footwear of claim 1 wherein said conductive material is woven and includes electrically conductive strands.

3. The footwear of claim 2 wherein said discharge edge is formed of the ends of said strands.

4. The footwear of claim 1 wherein said conductive material is a metal foil.

5. The footwear of claim 1 wherein said conductive material is a vacuum-deposited metal.

6. The footwear of claim 1 wherein said conductive material comprises stitches formed of an electrically conductive strand.

7. The footwear of claim 1 wherein said discharge edge has an effective radius of curvature of less than 125 microns.

8. The footwear of claim 1 wherein said bottom layer has a resistivity of at least $10^6$ ohm-cm.

9. The footwear of claim 1 including dielectric material arranged for insulating said conductive material from a foot in said footwear.

10. The footwear of claim 9 wherein said insulation between said foot and said conductive material has a resistivity of at least $5 \times 10^6$ ohm-cm.

11. The footwear of claim 1 wherein said conductive material is superposed over substantially all of said bottom layer.

12. The footwear of claim 1 wherein said discharge edge extends around substantially all of said outer periphery of said bottom layer.

13. The footwear of claim 1 including means for forming an electrically conductive path from said conductive material to the underside of said bottom layer.

14. A laminated, antistatic shoe bottom material comprising:

a. a dielectric material forming a bottom layer;

b. an electrically conductive material above said bottom layer;

c. said conductive material extending to the outer periphery of said bottom layer; and d. said conductive material having a discharge edge exposed to ambient atmosphere in the region of said outer periphery of said bottom layer.

15. The shoe bottom material of claim 14 wherein said conductive material is woven and includes electrically conductive strands.

16. The shoe bottom material of claim 15 wherein said discharge edge is formed of the ends of said strands.

17. The shoe bottom material of claim 14 wherein said conductive material is a metal foil.

18. The shoe bottom material of claim 14 wherein said conductive material is a vacuum-deposited metal.

19. The shoe bottom material of claim 14 wherein said discharge edge has an effective radius of curvature of less than 125 microns.

20. The shoe bottom material of claim 14 wherein said bottom layer has a resistivity of at least $10^6$ ohm-cm.

21. The shoe bottom material of claim 14 including means for forming an electrically conductive path from said conductive material to the underside of said bottom layer.

22. A laminated, antistatic shoe bottom material comprising:

a. a dielectric material forming a bottom layer;

b. an electrically conductive material above said bottom layer;

c. a dielectric material above said conductive material; and d. means for forming an electrically conductive path from said conductive material to the underside of said bottom layer.

23. Antistatic footwear comprising:

a. dielectric material forming a bottom layer of said footwear;

b. an electrically conductive material above said bottom layer;

c. dielectric material arranged for insulating said conductive material from a foot in said footwear; and d. means for forming an electrically conductive path from said conductive material to the underside of said bottom layer.

* * * * *